United States Patent [19]

Anderson et al.

[11] Patent Number: 5,073,409

[45] Date of Patent: Dec. 17, 1991

[54] ENVIRONMENTALLY STABLE METAL POWDERS

[75] Inventors: Iver E. Anderson, Ames, Iowa; Jack D. Ayers, Oakton, Va.

[73] Assignee: The United States of America as represented by the Secretary of the Navy, Washington, D.C.

[21] Appl. No.: 545,005

[22] Filed: Jun. 28, 1990

[51] Int. Cl.[5] ..... B05D 7/14

[52] U.S. Cl. ..... 427/217; 427/426; 164/46; 264/12; 75/338

[58] Field of Search ..... 427/216, 217, 255.4, 427/426; 164/46; 264/12; 75/338

[56] References Cited

U.S. PATENT DOCUMENTS

| | | | |
|---|---|---|---|
| 3,963,811 | 6/1976 | Tamura et al. | 427/216 X |
| 4,355,057 | 10/1982 | Slaughter | 427/216 |
| 4,619,845 | 10/1986 | Ayers et al. | 427/422 |
| 4,882,225 | 11/1989 | Fukui et al. | 427/255.4 X |

*Primary Examiner*—Shrive Beck
*Assistant Examiner*—Alain Bashore
*Attorney, Agent, or Firm*—Thomas E. McDonnell; Barry A. Edelberg

[57] ABSTRACT

Fine metal alloy powders coated with a protective film are disclosed which are produced by the gas atomization process. The protective films are formed during the gas atomization process by gas atomizing a molten mixture of a metal alloy containing an alloy addition agent in an atomizing gas which will selectively react with the alloy addition agent to form a thin protective film on the surface of the metal powder.

15 Claims, 1 Drawing Sheet

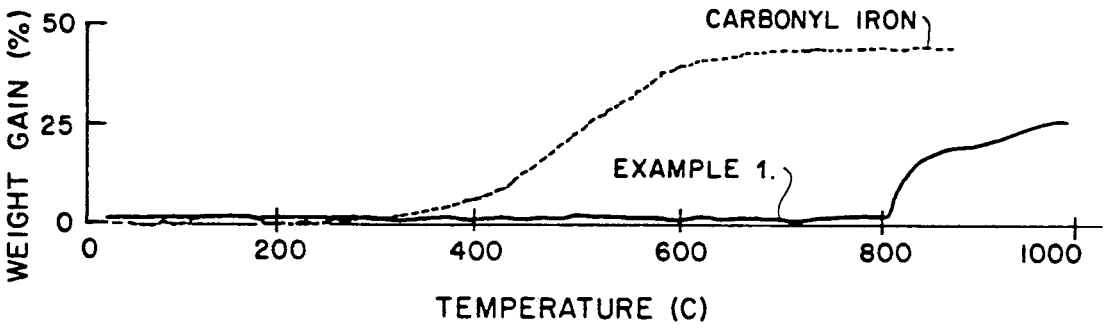
FIGURE

ENVIRONMENTALLY STABLE METAL POWDERS

BACKGROUND OF THE INVENTION

1. Field of Invention

This invention relates to metal alloy powders that are coated with a protective film during the production process and a process for making the metal alloy powders. The protective film provides for protection of the metal powders against environmental attack and reduces pyrophoric behavior of the powders.

2. Description of the Prior Art

Metal powders are produced by a number of different methods. For example, metal powders may be produced by gas atomization processes, water atomization processes, reduction metallurgy processes, carbonyl processes, or electrolytic processes. A preferred method of making fine spherical metal powders is by the gas atomization process. This process is preferred because, among other reasons, it is economical and provides for rapid production of the metal powder particles. The gas atomization process is limited only to the extent that the metal alloy composition can be melted and made to pour through a nozzle. A preferred gas atomization process is disclosed in our U.S. Pat. No. 4,619,845 entitled "Method For Generating Fine Sprays Of Molten Metal For Spray Coating And Powder Making".

Metal powders are used in a number of applications. For example, metal powders are used for thermally sprayed coatings, rapid solidification processed components, and metal injection molded parts. More specifically, component parts of diverse geometries may be fabricated by the consolidation of the powder with or without a binding agent. Parts formed with a binding agent are generally shaped in a mold at low or moderate temperatures, and parts formed without a binding agent are normally formed in a mold at low temperature and then heated to an elevated temperature where the individual metal particles are diffusively welded to one another.

Despite the usefulness of fine metal powders, they are sometimes difficult to use or work with due to their high surface to volume ratio which makes them more susceptible to environmental degradation than other metals such as bulk alloys of the same composition. This limitation manifests itself in that such metal powders are subject to environmental attack, for example, oxidation and corrosion. Additionally, some such metal powders tend to exhibit a pyrophoric behavior which presents danger in their manufacture, transportation, handling, and storage.

The prior art discloses various attempts and means for protecting metal powders against oxidation, corrosion, and spontaneous ignition. For example, it is known to make alloy powders more stable by producing thin oxide coatings on them by various methods. Specifically, it is known to produce oxide films on reactive metal powders atomized in an inert gas by slowly bleeding air or oxygen gas into the atomizer and the powder collection vessel. However, this process requires exacting slow bleeding rates to prevent temperature rise during the initial oxidation to avoid rapid and, in some cases, even catastrophic oxidation. Additionally, it is known that aluminum alloy powders with a thin protective oxide coating may be obtained by atomizing them in a reducing gas such as flue gas. This latter manner of production appears limited to aluminum alloys due to the physical and chemical properties of aluminum as the hydrogen and carbon in the flue gas can have undesirable effects with other metals.

Additionally, U.S. Pat. No. 4,170,466 discloses a water atomization process for producing fine metal particles of copper alloys with reduced levels of oxide and decreased danger of explosion of the hydrogen gas generated by oxidation of the metal by water. Water atomization is not a preferred manner of producing fine metal powders and is different from the gas atomization process in that a significantly enhanced oxygen content is usually obtained in water atomized powders. In addition, water atomized powders are generally non-spherical and thereby provide poor powder flowability and an elevated total surface area that impedes outgassing. Further, the process disclosed in this patent is not useful for alloys other than copper because the small silicon additives are not effective in preventing rapid oxidation of more reactive alloys.

Additionally, U.S. Pat. Nos. 4,240,831; 4,331,478; and 4,350,529 disclose corrosion-resistant stainless steel powders made by water or gas atomization to produce a powder with corrosion resistance. However, these latter patents do not disclose or want the formation of a protective film as in the present invention.

U.S. Pat. No. 4,187,084 discloses ferromagnetic abrasive materials and a method of making such materials by a carbonyl process. Other patents known to applicant disclosing various manners of making metal powders are U.S. Pat. Nos. 2,656,595; 3,892,600; 4,383,852; 4,572,844; 4,578,115; 4,810,284; and 4,833,040.

None of the above prior art provides for a fine, spherical metal alloy powder coated with a protective film during a gas atomization production process which can be made in a rapid and economic manner. As discussed hereafter, providing a protective film to metal alloy powders during the gas atomization production process is a novel improvement in the field of metal alloy powders.

SUMMARY OF THE INVENTION

It is a primary object of the invention to provide a fine metal alloy powder that is coated with a protective film during the gas atomization process.

It is a further primary object of the invention to provide a process for making a fine metal alloy powder that is coated with a protective film during the gas atomization production process.

It is a further object of the invention to provide a fine metal alloy powder having a protective film for protection of the metal powder against environmental attack.

It is a further object of the invention to provide for a rapid and economic process of producing a fine metal alloy powder coated with a protective film during the production process.

Additional objects of the invention will be apparent from the following disclosure of the invention.

Fine metal alloy powders coated with a protective film are disclosed which are produced by the gas atomization process. The protective films are formed during the gas atomization process by gas atomizing a molten mixture of a metal alloy and an alloy addition agent in an atomizing gas which will selectively react with the alloy addition agent to form a thin protective film on the surface of the metal powder. The metal alloys and gas compositions for use in the gas atomization process are selectively chosen to generate many different types of protective films. Presently preferred protective films for protection against environmental attack are oxide films and nitride films.

BRIEF DESCRIPTION OF THE DRAWING

A more complete appreciation of the invention will be readily obtained by reference to the following Detailed Description of the Invention and the accompanying drawing wherein the FIGURE represents comparative test results described in Test 2.

DETAILED DESCRIPTION OF THE INVENTION

The invention is directed to fine metal alloy powders coated with a protective film during a gas atomization production process. The fine metal alloy powders may be made using any type of gas atomization process. A preferred gas atomization process is disclosed in our U.S. Pat. No. 4,619,845 entitled "Method For Generating Fine Sprays Of Molten Metal For Spray Coating And Powder Making" which disclosure is incorporated herein by reference.

It is understood that those skilled in the art are familiar with production of metal powders by gas atomization. Generally, a metal alloy is heated to a molten state, i.e. liquified, in a furnace or other heat source. The molten metal is then conveyed from the furnace to a nozzle. The molten metal exiting the nozzle is subjected to the shearing force from a cooling gas issued from one or more openings surrounding and adjacent to the region in which the gas interacts with the molten metal. The gas atomizes the molten metal into liquid metal particles which upon cooling form the desired metal alloy powder. A specific atomization process useful with the invention is disclosed in our aforesaid U.S. Pat. No. 4,619,845.

Metal alloys and atomizing gas compositions can be selectively chosen to generate many different types of protective films. For example, oxide and nitride protective films have been found to be useful in protecting metal alloy powders from environmental attack. The fine metal alloy powders coated with a protective film are made by first forming a mixture of a metal alloy and an alloy addition agent. The mixture is then heated to its molten state. The molten alloy mixture is then atomized with an atomizing gas which is capable of reacting with the alloy addition agent to produce the desired protective film.

In forming the protective film, it is necessary to utilize a sufficient amount of the alloy addition agent to form a thin protective coating during the atomization process. The films are very thin since their thickness is limited by the short time available for reaction between the alloy addition agent and the reactive gas before the newly formed metal particle cools and solidifies. Accordingly, there need be only a sufficient amount of the alloy addition agent to render the desired reaction thermodynamically and kinetically favored. Effective alloy addition agent concentration may range from about 0.1 to 25 atomic percent of the metal alloy/alloy addition agent mixture, depending on the atomic mobility in the liquid alloy and the driving force for the coating reaction. Typically, about 0.5 to 15 atomic percent of the alloy addition agent is sufficient in the mixture of the metal alloy and alloy addition agent. The preferred range is about 10 atomic percent or less.

The amount of alloy addition agent required will depend upon the chemical reactivity of the alloy addition agent and upon the composition of the gas mixture employed to atomize the melt. For example, with mildly reactive alloy addition agents and gases, a larger amount of alloy addition agent may be necessary. The upper range for the alloy addition agent is limited only to the extent that too high a concentration of alloy addition agent may have an undesirable effect on the resultant metal alloy powder or its intended application, i.e. unreacted alloy addition agent is generally undesirable.

The amount of reactive gas required in the atomizing gas will vary slightly depending on the metal alloy composition to be atomized. Generally, 0.1% by volume to 1.0% by volume of a reactive gas in an otherwise inert gas are sufficient to react with the alloy addition agent to form a protective film. The effective concentration for reactive gas may range from about 0.1% to 100% by volume when the reactive agent is nitrogen; from about 0.1% to about by volume the reactive gas is oxygen; and from about 0.1% to 10% by volume when the reactive gas is a nonelemental gas such as ammonia or carbon dioxide. The preferred ranges for the reactive gas concentration is from about 0.2% to 1% by volume when the reactive gas is nitrogen; and from about 0.5% to 3.0% by volume when the reactive gas is a nonelemental gas such as ammonia or carbon dioxide.

Protective oxide films providing excellent protective properties against environmental attack have been formed by adding an alloy addition agent to the selected metal alloy and atomizing the molten mixture with an inert gas having from 0.2% to 1.0% by volume of oxygen. Metal alloys such as alloys containing iron, copper, and nickel are alloys on which an oxide film may be formed having good protective properties. Useful alloy addition agents include aluminum, silicon, chromium, yttrium, beryllium or one of the lanthanide series elements. The atomizing gas is generally an inert gas such as argon or helium gas containing the above specified percentage of oxygen or other oxygen-containing gases such as carbon dioxide.

Fine metal alloy powders having a protective nitride film have also been made of a metal alloy containing a small amount of an alloy addition agent and atomized in nitrogen gas. The resultant metal alloy powder was covered with a thin nitride film. Protective nitride coatings may be formed on metal alloys such as alloys based on iron, copper, nickel, cobalt or silver. Useful alloy addition agents in forming nitride films include silicon, titanium, zirconium, hafnium, niobium, tantalum or any other element which forms stable nitride films by atomizing the molten metal alloy mixture and alloy addition agent with the reactant gas. The atomizing gas may be nitrogen gas or an inert gas to which nitrogen is added or a nonelemental gas such as ammonia.

The invention is not limited to the formation of oxide and nitride films but may include other films, including carbides or silicides. It will be understood by those skilled in the art that such other protective films may be provided for many different metal alloys, including, for example aluminum or titanium.

Further examples disclosing the fine metal alloy powders with a protective film of the invention and the process for making it are disclosed in the following examples. The gas atomization process used in the examples was as defined in our U.S. Pat. No. 4,619,845.

EXAMPLE 1

A nitride film was formed on an iron alloy as follows. An iron alloy with a silicon alloy addition agent (3.7 weight percent silicon) charge weighing 700 grams was atomized with nitrogen gas (99.995% purity). The iron/silicon charge was melted in a magnesia (MgO) ceramic crucible with a boron nitride (BN) stopper rod and pour tube. The molten alloy in the crucible reached 1700° C. and then was poured through the pour tube into atomizer nozzle gas jets. The intent of this experiment was to form a protective layer of silicon nitride on the resulting metal alloy powder surfaces. Later auger analysis, as discussed below, indicated that the resulting metal alloy powder particles contained a boron nitride film and a silicon nitride film on the outer layers of the powder particles. Boron also served as the reactive alloy addition agent in this example due to the partial dissolution of BN stopper rod and pour tube during residence time in the crucible before pouring.

EXAMPLE 2

An oxide protective film was formed on a copper alloy as follows. A copper alloy and silicon alloy addition agent (12.6 atomic percent silicon) charge weighing 1800 grams was atomized with argon-oxygen, 1% oxygen by volume, gas mixture. The copper/silicon charge was melted in graphite crucible coated with a MgO mold wash layer. A graphite stopper rod and stainless steel pour tube, coated with a MgO layer, was used in the melting system. The molten alloy mixture in the crucible was allowed to reach 1140° C. before pouring it through the pour tube into atomizer nozzle gas jets. A protective layer of silica ($SiO_2$) and copper-silicon mixed oxide was formed on the powder surface by reaction of the silicon alloy addition agent with oxygen in Ar-$O_2$ atomization gas mixture.

Tests conducted to establish the protection provided by the protective films formed by the present invention and to establish the benefits of the present invention are as follows:

TEST 1

A powder surface chemical analysis conducted by Auger electron microscopy was performed on the metal powders made in Example 1 to determine the relative concentration of the chemical species on the outer surface of the powder and at several intermediate depths obtained by ion sputtering into individual powder particles. The outer surface layer on the iron-silicon alloy powders of Example 1 contains boron nitride, carbon, nitrogen, oxygen, and iron. As the depth profile proceeds into a particle, the signal from the iron increases significantly at the expense of all the above-mentioned components. A silicon signal also appeared just below the outer surface layer and grew to a stable, significant magnitude. These results establish that a nitride film coating, primarily boron nitride at the surface and silicon nitride just below the surface, was generated by reactive gas atomization (RGA) process of the invention.

TEST 2

A comparison was made of the powders from Example 1 (particle diameter less than 10 micrometers) and a commercially obtained carbonyl iron (pure iron spherical particles, particle diameter from 6 to 10 micrometers). A powder surface oxidation resistance test, characterized by thermogravimetric analysis (TGA), was performed on these powders to determine the temperature dependence on heating of powder oxidation process measured by sample weight gain. Powder samples of each of the powders weighing from 30 to 60 mg were loaded into platinum pans for TGA. A small resistance furnace that contained a sample pan was used to raise sample temperature from ambient to about 900° C. at a programmed heating rate of 10° C./minute in an atmosphere of "breathing air", flowing at a constant rate. The results in the FIGURE establish that the onset of powder sample oxidation occurred at temperatures of 420° C. for the carbonyl iron and 800° C. for the Example 1 powder. The results show superior oxidation protection by the nitride protective film of Example 1 in comparison to the untreated iron carbonyl powder.

TEST 3

A powder surface chemical analysis was conducted by Auger electron microscopy on the metal powders of Example 2 to determine the relative concentration of chemical species on outer surface and at several intermediate depths obtained by ion sputtering into individual powder particles. The outer surface layer on the copper-silicon powders from Example 2 contained silicon, oxygen, carbon, sulfur, and copper. As depth profile proceeds into the bulk of a particle, the signal from Cu increases significantly, the silicon decreases slightly, and the signals from oxygen, carbon, and sulfur fall to residual levels. The results indicate that a silica ($SiO_2$) coating was generated on the powder of Example 2 by RGA.

As will be apparent to one skilled in the art, various modifications can be made within the scope of the aforesaid description. Such modifications being within the ability of one skilled in the art form a part of the present invention and are embraced by the appended claims.

It is claimed:

1. A method of preparing an environmentally stable metal powder coated with a protective film during a gas atomization process comprising:

(a) mixing a metal alloy with a sufficient amount of a metal alloy addition agent which is compatible with the metal alloy and which will react with the atomization gas during the gas atomization production process to form a film on the metal powder;

(b) heating said mixture of a metal alloy with said metal alloy addition agent to a temperature at which said alloy and said alloy addition agent melt and form a molten mixture of said metal alloy and said alloy addition agent;

(c) atomizing said molten mixture with an atomizing gas having a sufficient amount of a reactant gas to react with the alloy powder produced by the gas atomization process, whereby a metal alloy powder is produced during the gas atomization producing process having a thin protective film on the metal powder.

2. The method of claim 1 wherein said protective film is an oxide film formed on metal alloys selected from the group consisting of iron, copper, and nickel alloys.

3. The method of claim 2 wherein said metal alloy addition agent is selected from the group consisting of aluminum, silicon, chromium, yttrium, beryllium and lanthanide series elements.

4. The method of claim 3 wherein the metal alloy addition agent is present in the rang of 0.1 to 25 atomic percent of the mixture of the alloy and alloy addition agent.

5. The method of claim 2 wherein said atomizing gas has an oxygen content in the range of from about 0.1% to 16% by volume.

6. The method of claim 1 wherein said protective film is a nitride film formed on said metal alloy selected from the group consisting of iron, copper, nickel, cobalt and silver.

7. The method of claim 6 wherein said metal alloy addition agent is selected from the group consisting of silicon, titanium, zirconium, hafnium, niobium, and tantalum.

8. The method of claim 7 wherein the metal alloy addition agent is present in the range of 0.1 to 25 atomic percent of the mixture of the alloy and alloy addition agent.

9. The method of claim 6 wherein said atomizing gas has a nitrogen content in the range of 0.1% to 100% by volume.

10. A method of preparing an environmentally stable metal powder coated with a protective oxide film during a gas atomization process comprising:

(a) mixing a metal alloy selected from the group consisting of iron, copper, and nickel alloys with a sufficient amount of a metal alloy addition agent selected from the group consisting of aluminum, silicon, chromium, yttrium, beryllium and lanthanide series elements which will react with the atomization gas during the gas atomization production process to form an oxide film on the metal powder;

(b) heating said mixture of a metal alloy with said metal alloy addition agent to a temperature at which said alloy and said alloy addition agent melt and form a molten mixture of said metal alloy and said alloy addition agent;

(c) atomizing said molten mixture with an atomizing gas having a sufficient amount of reactant oxygen gas to react with the alloy addition agent to form an oxide film on the metal alloy powder produced by the gas atomization process, whereby a metal alloy powder is produced during the gas atomization producing process having a thin oxide protective film on the metal powder.

11. The method of claim 10 wherein said metal alloy addition agent is present in the range of 0.5 to 15 atomic percent of the mixture of the alloy and the alloy addition agent.

12. The method of claim 10 wherein said atomizing gas has an oxygen content in the range of 0.2% to 1% by volume.

13. A method of preparing an environmentally stable metal powder coated with a protective nitride film during a gas atomization process comprising:

(a) mixing a metal alloy selected from the group consisting of iron, copper, nickel, cobalt, and silver alloys with a sufficient amount of a metal alloy addition agent selected from the group consisting of silicon, titanium, zirconium, hafnium, niobium, and tantalum which will react with the atomization gas during the gas atomization production process to form a nitride film on the metal powder;

(b) heating said mixture of a metal alloy with said metal alloy addition agent at a temperature at which said alloy and said alloy addition agent melt and form a molten mixture of said metal alloy and said alloy addition agent;

(c) atomizing said molten mixture with an atomizing gas having a sufficient amount of reactant nitrogen gas to react with the alloy addition agent to form a nitride film on the metal alloy powder produced by the gas atomization process, whereby a metal alloy powder is produced during the gas atomization producing process having a thin nitride protective film on the metal powder.

14. The method of claim 13 wherein said metal alloy addition agent is present in the range of 0.5 to 15 atomic percent by weight of the mixture of the alloy and alloy addition agent.

15. The method of claim 13 wherein said atomizing gas has a nitrogen content in the range of 0.2% to 100% by volume.

* * * * *